United States Patent [19]

Walter

[11] 4,356,924

[45] Nov. 2, 1982

[54] CONTAINER CLOSURE WITH RETAINER HINGE

[75] Inventor: John Walter, Evergreen Park, Ill.

[73] Assignee: The Continental Group, Inc., Stamford, Conn.

[21] Appl. No.: 242,758

[22] Filed: Mar. 11, 1981

[51] Int. Cl.[3] ..... B65D 39/00

[52] U.S. Cl. ..... 215/237; 220/335

[58] Field of Search ..... 215/235, 237; 220/335

[56] References Cited

U.S. PATENT DOCUMENTS 3,272,368 9/1966 Van Baarn ..... 215/235

*Primary Examiner*—Donald F. Norton

*Attorney, Agent, or Firm*—John J. Kowalik

[57] ABSTRACT

A container closure having a lever tethered to a plug and the plug being tethered to the pouring neck, the tether between the plug and neck being formed as part of a retainer hinge which interlocks with a cooperative pin mounted to the neck.

13 Claims, 6 Drawing Figures

CONTAINER CLOSURE WITH RETAINER HINGE

BACKGROUND OF THE INVENTION

Containers of the type under consideration consist of a cylindrical body with either an integral or seamed bottom and have a domed or tapered upper end with a narrow neck which is associated with a closure.

The invention is directed to a novel hinge structure for the closure plug which, when the closure is opened, the plug and the opening mechanism will lay and be held to one side of the pour opening so as not to interfere with the dispensing of the contents.

DESCRIPTION OF THE PROBLEM

After considering various types of closures which have hinged closures, a number of problems were noted. The most objectionable problem has been the lack of simple means for holding the closure plug away from the pour opening. Structures of the general type under consideration have been heretofore made, but either require separate molding operations or costly molding equipment to make. A further problem arises in prior art structures in the difficulty of interlocking the parts to hold the plug in non-obstructing position and wherein the parts easily unsnap to permit reinsertion of the plug to closed position.

SOLUTION OF THE PROBLEM

The closure of the instant invention has been made to minimize the amount of material used and also providing a novel combined venting and opening-facilitating leverage structure with enhanced sealing integrity and an arrangement for tethering the plug and leverage structure wherein the tethers serve as a hinge which is formed to releasably interlock with a catch formed on one of the other parts of the closure.

SUMMARY OF THE INVENTION

This invention is directed to closures and, more particularly, to a novel hinge structure for the closure plug.

A main object of the invention is to provide a closure which may be easily inserted into the open end of a container and in which parts are positionable in a non-obstructing position to pouring or direct drinking from the container and wherein the parts are easily reassembled to a closed position.

A further object is to provide a novel closure having several parts tethered to each other and which are made as a simple unitary structure and wherein one of the tethers is formed as a split hinge which releasably interlocks with a positioning part.

Another object is to provide a plastic closure which is made as a single unit in a simple molding operation.

These and other objects inherent in and encompassed by the invention will become more apparent from the specification and the drawings wherein.

DESCRIPTION OF THE INVENTION

Figure 1:
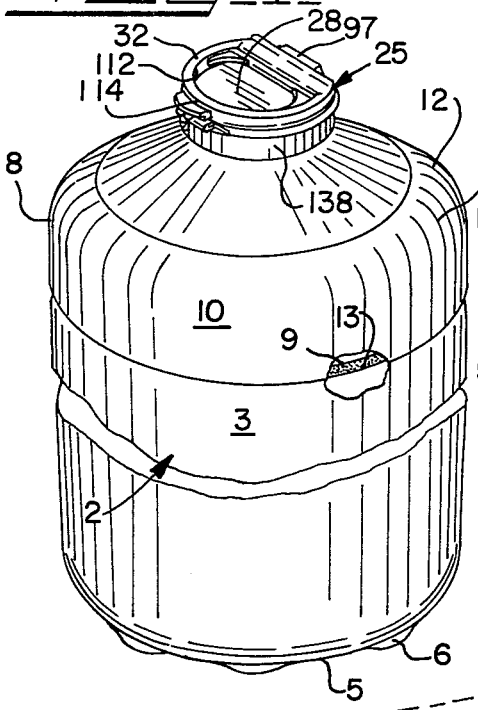
FIG. 1 is a perspective view of the novel container incorporating the invention.

The invention is shown applied to a container 2 made of metal such as aluminum and comprising a cylindrical body 3 with an integral outwardly convexed bottom 5 which is provided with outwardly protruding dimples 6 upon which the container rests. It will be understood that the invention is applicable to other types of containers, metal as well as plastic.

The upper open end portion 8 of the body 3 has a necked-in portion 9 which fits into an annular skirt portion 10 of a dome member 12 which forms the upper end of the container. A suitable adhesive 13 bonds the portion 9 to the skirt 10. The dome member 12 is formed with a stepped neck 14 and a toroidal section 18. The member 13 provides at its neck 14 a shoulder 20 and an access opening 22 (FIGS. 5 and 6) at the upper end of the container, the neck 14 terminating in a curl 24.

A semi-flexible plastic closure 25 is provided at the upper end of the container and comprises a tubular neck or sleeve portion 26, a closure plug portion 28 and a venting portion 30 to which is attached a finger grip lever or handle 32.

The neck portion 26 is a cylindrical member which at its lower end is tapered at 36 and is tightly wedged through the opening 22 (FIG. 6) and then expands radially outwardly and engages its shoulders 38 under the edge of shoulder 20 of the neck portion 14.

The neck portion 26 has an upper outwardly projecting annular flange 40 which engages the top edge of the curl 24 and provides a fluid-tight pressure seal with the shoulder 38.

The interior bore surface 50 of the neck portion provides a pour and fill opening and is provided with a locking ring member or shoulder 52 which has a downwardly sloping upper surface 56 merging into an apical edge 58 with a bottom locking surface 60 which extends normal to the axis of the neck portion. Above the ring 52 the bore surface is partly of frusto-conical shape which widens toward the upper end and has a cylindrical portion 61 to facilitate entry of the lower end portion 62 of the closure plug 28.

The plug 28 has a hollow cylindrical side wall 65 which is provided intermediate its upper and lower edges with an annular locking ring or rib 66 which is of generally triangular cross-section having a lower downwardly tapered pilot surface 67 which is adapted to be guided past surface 61 and upon engagement with the upper similarly tapered face 56 of the neck of sleeve locking ring 52 and past the apex 58 when the plug or cap is pressed into the neck opening or bore 50 whereupon an apical edge 68 is deflected with edge 58 and the locking ring or shoulder 66 on the cap is stepped under the shoulder 52 of the neck portion 26 and a flat radially outwardly extending surface 69 at the upper end of the shoulder 66, normal to the axis of the neck or sleeve, locks under the face 60.

The plug portion or cap 28 has a top wall 70 integral with the upper end of the plug 28, the wall 70 extending beyond the perimeter of the plug and forms an annular rim portion 72 which on its underside is pressed in position against the top surface 75 of the annular flange 40 integral with and extending radially outwardly from the upper end of the neck portion 26.

A tether or hinge in the form of a pair of narrow parallel straps 80 connect a peripheral edge of flange 72 with a peripheral edge of portion 40 of the neck member 26.

The wall 70 is provided close to its marginal edge with a vent opening 84 in an area diametrically opposite to the tether 80 adjacent to the interior surface of the wall 65 of the plug.

A frusto-conical pilot cavity 86 is formed at the upper end of opening 84 for guiding the male venting closure pin or element 30 which in the closed position extends into the opening 84.

Figure 5:
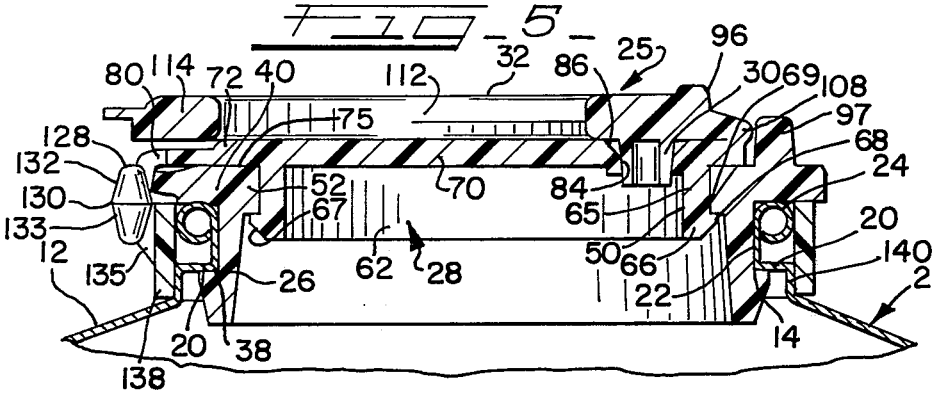
FIG. 5 is an enlarged cross sectional view taken substantially on line 5—5 of FIG. 2.
Figure 6:
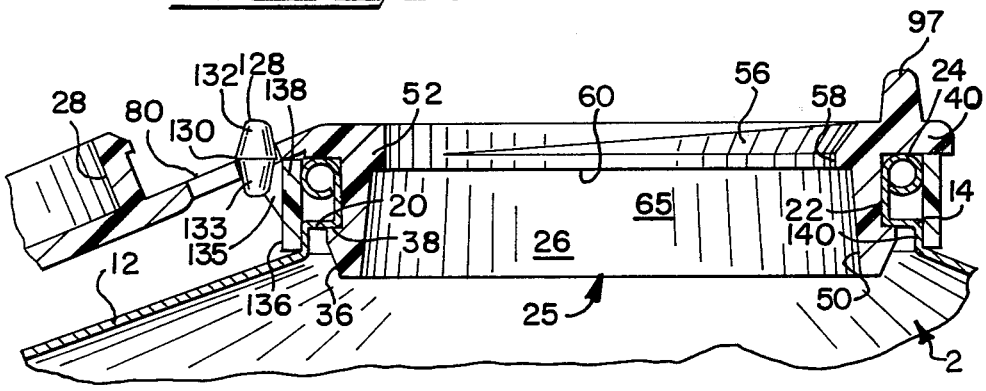
FIG. 6 is a fragmentary enlarged sectional view similar to FIG. 5 showing the hinged open position of the closure.

The upper end of the closure element or vent pin 30 depends from and is integrally connected with the lever member 32 intermediate its ends. The lever or handle 32 has a fulcrum end 96 which engages with the top edge of a combination pouring lip and fulcrum post 97 formed on the top side of the flange 40. As seen in FIG. 5, the lever 32 is connected below the fulcrum end 96 to one end of a narrow strap 108 which is folded and which has its other end connected to the outer edge of flange 72 in an area diametrically opposite the strap 80.

Thus, to open the closure shown closed in FIGS. 1, 2, 4 and 5, the user inserts his finger through the ring hole 112 and lifts on portion 114 diametrically opposite the strap 108 thus lifting the fulcrum end portion 96 outwardly and withdrawing the vent plug 30 from opening 84. Continued rotation of the lever or handle engages the fulcrum portion 96 against the post or ledge 97 and further pivotal movement rightward (FIGS. 1, 2 and 5) pries the plug 28 out of the sleeve 26. Removal of the pin or plug 30 removes the support for the plug wall 65 in the immediate area and thus enhances the flexure of that portion of the wall 65, that is, in the region of the vent opening whereby as the lever is fulcrumed, it pulls on the tether 108 which, in turn, curls the adjacent portion 72 of the top wall 70 upwardly and causes the portion of the wall 70 contiguous to the vent opening to warp radially inwardly thus facilitating partially unhooking of the ledge or shoulder 66 from under the shoulder 52 and disengaging the locking face 69 from face 60. The plug 28 then easily lifts out of the neck or sleeve opening.

The feature of the invention is the provision of the novel hinge arrangement 125 which comprises not only the straps 80 which define a gap or slot 126 therebetween, but also an upright post 128 of fusiform shape having a middle thick diameter section 130 and upper and lower tapered ends 132 and 133 which form a catch member. The post is connected at its inner side by a thin upright stand-off bracket wall 135 to the outside periphery 136 of a mounting ring 138 which is tightly fitted over the outer edge of the curl 24 of the neck portion 14 of the container and an enlarged lower end portion 140 of the neck 14.

Figure 2:
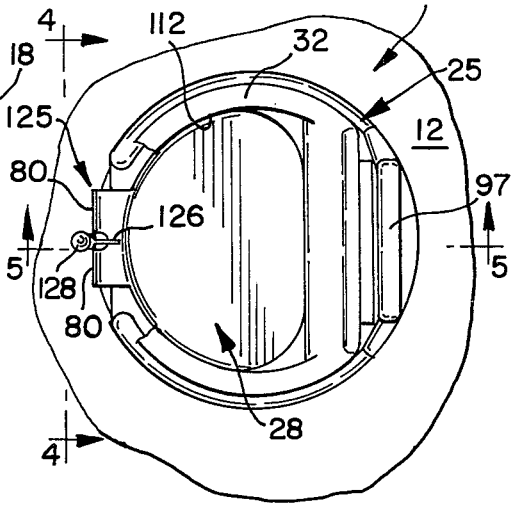
FIG. 2 is a top plan view thereof.
Figure 3:
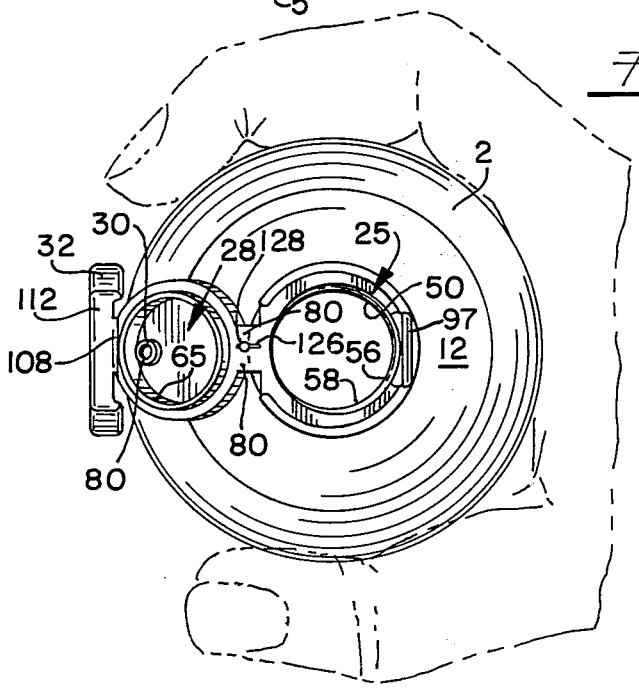
FIG. 3 is a top view with the container and the closure hand held in open position.
Figure 4:
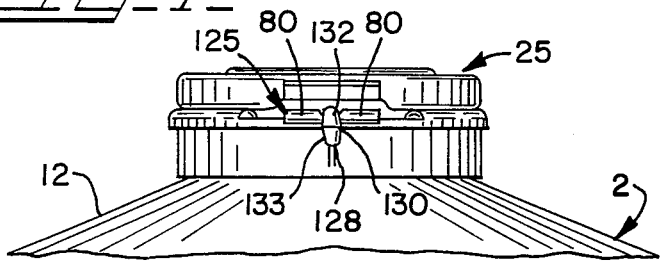
FIG. 4 is an enlarged side elevational view taken substantially on line 4—4 of FIG. 2.

As best seen in FIGS. 2 and 4, the strips 80 in the closed position of the closure flank the upper end portion 132 of the post and are partially spread apart and will wedge past the central enlarged catch section 130 when the plug is withdrawn and is positioned with the lever 32 at one side of the neck 14. It will be seen in FIG. 6 that portions of the strips 80 outwardly of the vertical axis of the post are below the enlarged catch portion 130 and thus will hold the plug and handle essentially as shown in FIG. 3. Of course, the container may be rotated 90° from that shown in FIG. 3 so that the user may drink over the lip 97.

To reclose, the handle 32 is lifted with the plug 28, releasing it from the post catch 130 and allowing the plug 28 to be snapped into the neck sleeve 28 whereupon the handle 32 is folded over the top of the plug entering member 30 into opening 84. The hinge 125 then assumes the position of FIG. 5 with the straps 80, 80 partly embracing the upper portion 132.

What is claimed is:

1. A closure for a container, said closure having a neck with a bore providing a pour opening, a plug adapted to be inserted into said opening for closing it, hinging means hinging said plug to said neck, a tab for moving said plug to an open position tethered to said plug diametrically opposite to said hinging means, said hinging means and means disposed adjacent said neck having releasably cooperative parts operative to hold said plug in said open position at one side of said pour opening with said tab extended radially outwardly of said neck.

2. The invention according to claim 1 wherein said hinging means includes strap means extending between said neck and said plug, and said releasable cooperative parts includes said strap means and a catch positioned adjacent said neck engageable with said strap means.

3. The invention according to claim 2 wherein said hinging means comprises a pair of flexible straps, and said catch is positioned to enter between said straps in interlocking relation therewith.

4. The invention according to claim 3 and said catch being in the form of a post having a fusiform shape.

5. The invention according to claim 4 and said post having an upper end part having a portion disposed between said straps in the closed position of said plug and said upper end part tapering from its midsection upwardly and being entered endwise between said straps in said closed position of said plug for piloting said post to said open position between the straps attendant to movement of said plug.

6. The invention according to claim 5 and said midsection of said post being positioned to enter sufficiently between said straps in the open position of said plug and tab at one side of said pour opening to securely interlock with said straps and thus hold said hinge means in a position to bias said plug and said straps in said open position extending radially outwardly of said neck.

7. A closure for a container, said closure comprising a neck member with a pour opening and a plug member adapted to be inserted into said pour opening for closing it and being withdrawable from said pour opening to an open position, hinge means connecting said members, and means associated with said hinge means for holding said plug member in said open position comprising a catch element mounted adjacent said neck member, said hinge means comprising flexible strap means defining a slot for receiving said catch element attendant to said strap means being forced thereover for holding the plug in a laid over position radially outward of said neck member.

8. The invention according to claim 7 and said catch element having a wedge surface partly entered into said slot in the closed position of said plug for guiding said strap means into an interlocking position with said catch element.

9. The invention according to claim 8 and said catch element being in the form of a post tapered outwardly at each end of said post and having a large diameter midsection, and said strap means comprising a pair of laterally separated portions defining said slot and upon opening of said plug being adapted to slide over one end of said post and at least a portion of the midsection.

10. The invention according to claim 9 and said strap means being made of distortable plastic material.

11. A closure for a container, said closure comprising a tubular member having first means defining a pour opening and second means for sealed engagement with a container, closure means for closing said pour opening, hinging means for hinging said closure means to said tubular member for movement between open and closed positions relative to said pour opening, and interengaging means on said hinging means and means positioned adjacent said tubular member for holding said closure means in said open position to facilitate pouring or drinking directly from said pour opening.

12. The invention according to claim 11 and said interengaging means comprising a catch member fixedly positioned adjacent said tubular member and a member of said hinging means having releasably means engageable with said catch member.

13. The invention according to claim 12 and said catch member comprising a post with a tapered part and said releasable means comprising a slot in a strap receiving said tapered part therethrough, said tapered part being partly wedged in said slot in the closed position of the closure means and operative to guide said strap onto said tapered part attendant to said closure means being disposed in said open position.

* * * * *